US007633451B2

(12) United States Patent
Robin et al.

(10) Patent No.: US 7,633,451 B2
(45) Date of Patent: Dec. 15, 2009

(54) WIDEBAND ANTENNA SYSTEMS AND METHODS

(75) Inventors: Seymour Robin, Woodland Hills, CA (US); Rajah Castillo, Valencia, CA (US)

(73) Assignee: Sensor Systems, Inc., Chatsworth, CA (US)

( * ) Notice: Subject to any disclaimer, the term of this patent is extended or adjusted under 35 U.S.C. 154(b) by 658 days.

(21) Appl. No.: 11/488,540

(22) Filed: Jul. 17, 2006

(65) Prior Publication Data

US 2007/0210972 A1 Sep. 13, 2007

Related U.S. Application Data

(60) Provisional application No. 60/781,263, filed on Mar. 9, 2006.

(51) Int. Cl.
*H01Q 1/28* (2006.01)

(52) U.S. Cl. ..... 343/705; 343/708; 343/700 MS

(58) Field of Classification Search ..... 343/700 MS, 343/705, 708, 872
See application file for complete search history.

(56) References Cited

U.S. PATENT DOCUMENTS 4,015,263 A 3/1977 Koerner et al. ..... 343/708
4,438,437 A 3/1984 Burgmyer ..... 343/770
4,509,053 A * 4/1985 Robin et al. ..... 343/708
4,649,396 A 3/1987 Friedman ..... 343/705
4,860,020 A 8/1989 Wong et al. ..... 343/828
5,070,340 A 12/1991 Diaz ..... 343/767
5,745,079 A * 4/1998 Wang et al. ..... 343/700 MS
5,959,586 A 9/1999 Benham et al. ..... 343/713
6,061,031 A 5/2000 Cosenza et al. ..... 343/770
6,175,336 B1 1/2001 Coughlin et al. ..... 343/708
6,208,304 B1 3/2001 Strickland ..... 343/705
6,339,409 B1 1/2002 Warnagiris ..... 343/895
6,501,427 B1 * 12/2002 Lilly et al. ..... 343/700 MS
6,518,931 B1 2/2003 Sievenpiper ..... 343/770
6,734,828 B2 5/2004 Shor ..... 343/795
6,873,296 B2 3/2005 Langley et al. ..... 343/705
7,221,323 B2 * 5/2007 Schantz et al. ..... 343/700 MS
7,242,365 B1 * 7/2007 Boatman et al. ..... 343/872

* cited by examiner

*Primary Examiner*—HoangAnh T Le
(74) *Attorney, Agent, or Firm*—Koppel, Patrick, Heybl & Dawson

(57) ABSTRACT

Antenna system embodiments are shown which are especially suited for mounting on aircraft and for operation across widely-spaced frequency bands. Embodiments include blade members positioned in a ring arrangement and tuning circuits that are each coupled between a respective pair of the blade members and configured to successively remove blade members from operation as the operational frequency increases.

15 Claims, 8 Drawing Sheets

VSWR PATTERN
250 MHz - 2.5 GHz

RL PATTERN 2.5 GHz

WIDEBAND ANTENNA SYSTEMS AND METHODS

CROSS REFERENCES TO RELATED APPLICATIONS

This application claims the benefit of U.S. Provisional Application Ser. No. 60/781,263 filed Mar. 9, 2006.

BACKGROUND OF THE INVENTION

1. Field of the Invention

The present invention relates generally to antenna structures.

2. Description of the Related Art

There exist numerous systems (e.g., communication systems) which have a need for antenna structures that can operate over extended frequency ranges and still exhibit superior performance in various antenna operational parameters (e.g., antenna gain patterns, antenna voltage standing wave ratio (VSWR), and return loss (RL). Unfortunately, it has been found difficult to realize structures that can meet these needs. When these demands are combined with the requirement that the antenna structures must be carried on high speed aircraft, their realization becomes especially difficult.

BRIEF SUMMARY OF THE INVENTION

The present invention is generally directed to wideband antenna systems and methods. The drawings and the following description provide an enabling disclosure and the appended claims particularly point out and distinctly claim disclosed subject matter and equivalents thereof.

DETAILED DESCRIPTION OF THE INVENTION

Figure 1:
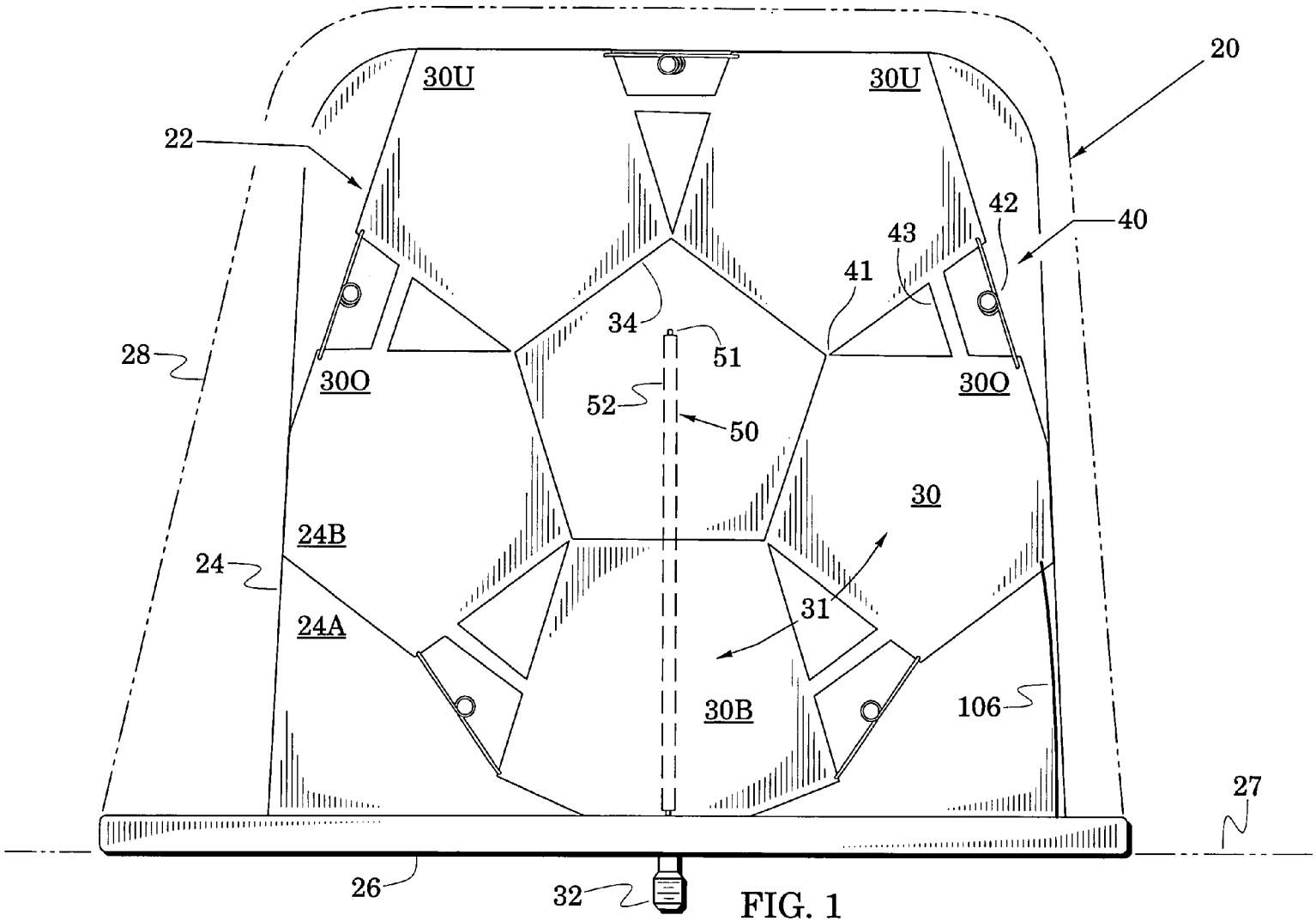
FIG. 1 is a side view of an antenna embodiment of the present invention.
Figure 2C:
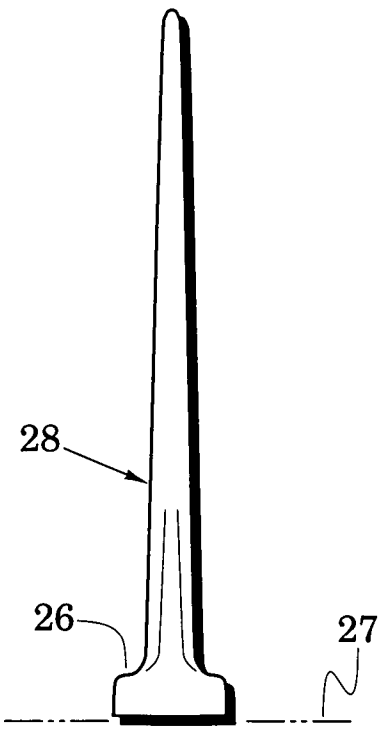
FIGS. 2A, 2B and 2C are respectively side, bottom and end views of outer surfaces of the embodiment of FIG. 1.
Figure 2A:
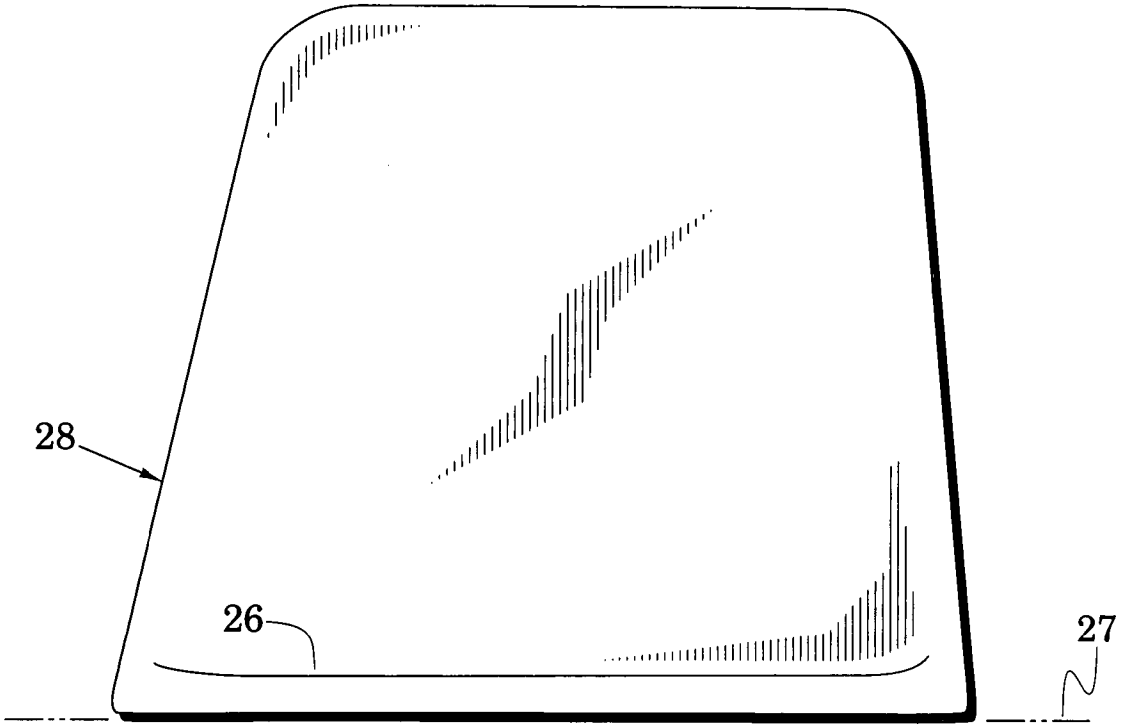
Figure 2B:
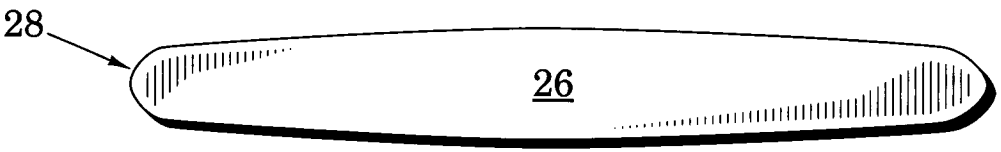
Figure 3:
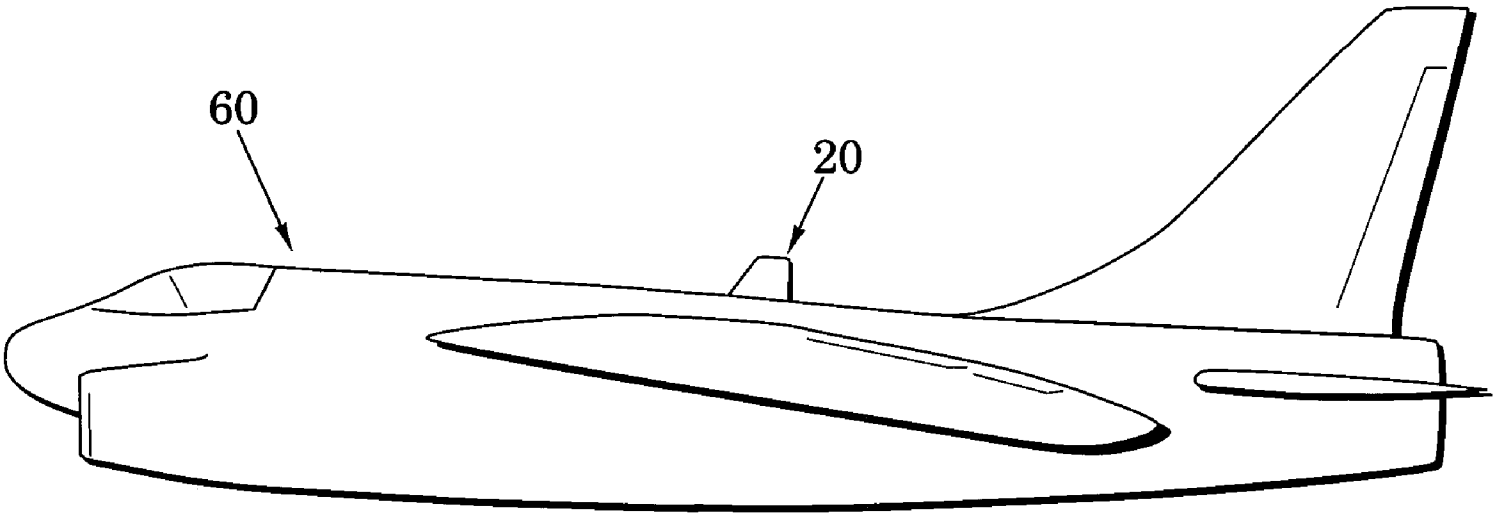
FIG. 3 is a side view of an airplane which includes the side view of FIG. 2A.

FIGS. 1-3 illustrate an antenna system embodiment of the present invention and FIGS. 4A-7B illustrate measured performance of an embodiment for different antenna parameters. The system embodiments shown are especially suited for mounting on aircraft and the measured performances shown that they can successfully operate across widely-spaced frequency bands. Embodiments include blade members positioned in a ring arrangement and tuning circuits that are each coupled between a respective pair of the blade members and configured to successively remove blade members from operation as the operational frequency increases.

In particular, FIG. 1 is a side view of an antenna system embodiment 20. The system includes a blade antenna 22 carried on and supported by an electromagnetically-transparent dielectric sheet 24. The sheet may be formed from various electromagnetically-transparent materials 24A (e.g., fiberglass) and antenna structures may be formed from various metals 24B (e.g., copper) that are adhered to the sheet. For example, the antenna structures and the sheet may be economically formed from a copper-clad dielectric panel. In the embodiment of FIG. 1, the sheet 24, with its supported antenna 22, is secured to a mounting plate 26 which also serves as a ground plane.

The system 20 is structured to enhance the radiation and reception of electromagnetic signals in widely-spaced frequency bands (e.g., VHF, UHF and L bands) and, although it may be used in various applications, it is especially suited for use with commercial and military aircraft such as the airplane 60 that is shown in FIG. 3. In an aircraft application, the ground plane of the mounting plate 26 may be effectively extended by the airplane's outer skin 27 to which it is secured in FIG. 1. The antenna 22 and the dielectric sheet 24 are preferably protected by an electromagnetically-transparent and aerodynamically-shaped radome 28. The plan shape of the mounting plate preferably conforms to the shape of the radome as shown in FIGS. 2A-2C.

As shown in FIG. 1, the antenna 22 comprises a plurality of blade members 30 that are generally arranged in a ring arrangement 31 with a base member 30B positioned adjacent the mounting plate 27 where it can communicate with a conductive path for exchange of electromagnetic energy. The conductive path can be provided, for example, by a coaxial connector 32 that is carried by the mounting plate 26 with its center conductor (not shown) connected to the lower portion of the base member 30B. The connector 32 thus facilitates coupling of signals to and away from the system 20.

In at least one embodiment, the blade members 30 are N-sided polygons. In the embodiment of FIG. 1, for example, N is five so that the blade members are configured as pentagons. The ring arrangement 31 of FIG. 1 is formed with five blade members so that the overall shape of the antenna 22 is also that of a pentagon. Because of the ring arrangement, the blade members 30 define a generally-pentagonal aperture 34 in the middle of the ring arrangement 31. In other ring embodiments, N may take on other values such as 3 and 4. In yet other ring embodiments, N may be a large number so that the blade members become essentially circular discs.

Although the blade members do not have to be interconnected, adjacent blade members 30 are connected in the embodiment of FIG. 1 by a tuning circuit 40 which may be formed with a combination of tuning elements that act to match the blade members. In this embodiment, each tuning circuit includes a reactive element 42 adjacent the outer edge of the antenna 22. Preferably, each tuning circuit also includes a restricted path 41 adjacent the aperture 34 and a stub member 43 positioned between the elements 41 and 42.

The width of the restricted path 42 may, in some embodiments, be restricted nearly to a point. In the extreme, it may be eliminated so that the blade members are not contiguous. Although the reactive element can be a capacitor in other antenna embodiments, it is shown as an inductor in the system 20. In different antenna embodiments, the width and location of the stub member 43 can be varied and the tuning circuits can include resistors and attenuators to enhance antenna gain patterns and VSWR. As shown in FIG. 1, adjacent ones of the blades can be modified to define their respective path 41 and stub member 43. That is, the blades, path and stub are all defined by the metal 24B layer of the dielectric sheet 24.

The system 20 is especially configured to reduce the number of electromagnetically-involved blade members as the frequency of antenna operation increases. At the lower end of its operating band, for example, the system 20 of FIG. 1 essentially radiates and receives electromagnetic signals from all of its blade members 30 so that the antenna electromagnetically appears to be a single large pentagonal member comprising all blade members.

The tuning circuits 40 are configured so they begin to reduce the radiating and receiving functions of the upper blade members as the operational frequency continues to increase. As the operational frequency is increased, for example, the upper two blade members 30U initially begin to be removed from operation and this removal is subsequently followed by the two outer blade members 30O.

Accordingly, when the frequency of operation has reached the upper limit of the system 20, only the base member 30B is essentially involved in radiating and receiving of electromagnetic signals. It may be considered that the blade members 30 are phase-linked together so that they operate as a single large member at the lowest operating frequencies and only the base member 30B is operational at the highest operating frequencies.

In a system embodiment, the antenna 20 may be dimensioned such that, when all blade elements are operationally functional at the lower operational frequencies, the antenna height is on the order of ¼ of the operational wavelength. The base members 30B may be dimensioned so that the height, in particular, of the base member 30B is on the order of ¼ of the operational wavelength at the highest operational frequencies.

The size and shape of the base member 30B may, for example, be further altered to enhance the system's VSWR and antenna gain patterns. Accordingly, the areas and patterns of the blade members 30 are not necessarily identical. In the system embodiment 20, an outer portion of the outer blade members 30O is also missing to accommodate the dimensions of the dielectric sheet 24.

The operation described above is facilitated and enhanced by the arrangement of the tuning circuits 40. In different embodiments, the tuning circuit 40 can be appropriately modified to best realize the above-described operation. For example, the width and location of the path 41 can be altered, the reactance and position of the reactive element 42 can be altered, and the width and location of the stub member 43 can also be altered to enhance the system's performance. In addition, the reactive elements may be capacitive elements or may be replaced or augmented with resistive elements. The relative positions of the tuning elements 41, 42 and 43 may also be interchanged.

In the embodiment of FIG. 1, for example, the reactive elements 42 adjacent the base member 30B each have a first inductance, the outer reactive elements 42 each have a second inductance that exceeds the first inductance and the upper reactive element 42 has a third inductance that exceeds the second inductance. Although this reactive relationship is indicated in FIG. 1 by the number of coils, the coils shown are only for illustrative purposes to indicate that the reactance (for any selected operational frequency) increases from the lower to the upper reactive elements. Thus, at low frequencies the upper reactive elements present significant inductance while the lower reactive elements only present significant inductance at the high end of the operational frequency band.

The system 20 of FIG. 1 preferably includes a secondary antenna element in the form of monopole antenna element. This antenna element may be secured by various attachment means (e.g., epoxy and/or attachment devices) to one side of the dielectric sheet 24. In the embodiment 20, the monopole has the form of a sleeve element 50 and is secured to the sheet side opposite the blade members.

In particular, the sleeve element can be a coaxial tube having a center conductor 51 that is carried within an outer shield 52. The center conductor 51 is connected to the center conductor of the connector 32. As previously mentioned, the connector provides a conductive path for exchange of electromagnetic energy with the base member 30B so that it also provides a conductive path for exchange of electromagnetic energy with the monopole element. In the system embodiment of FIG. 1, the shield 52 is floating (i.e., it is not electrically tied to another member such as the mounting plate 26) but, in other antenna embodiments, it may be coupled, for example, to the outer shield of the connector 32.

Although the center conductor 51 is shown extending slightly from the shield 52 in FIG. 1, it may be substantially flush with the end of the shield in other embodiments. The monopole element 50 is typically terminated so that its upper end lies within the aperture 34. In a system embodiment, for example, the length of the sleeve element 50 may be on the order of 40% to 70% of the height of the antenna 22.

In general, the sleeve element 50 is configured and arranged to enhance the system performance. It is particularly effective in improving the system's VSWR and gain performance. Although not specifically shown in FIG. 1, matching circuits and attenuator circuits can also be inserted between the connector 32 and the base member 30B to further enhance and alter performance in given system embodiments. They or variations of them may also be inserted between the connector 32 and the sleeve element 50.

The radome 28 of FIG. 1 provides mechanical protection to the system and is preferably formed from electromagnetically-transparent materials (e.g., fiberglass) so as to not interfere with system performance. As previously mentioned, antenna system embodiments of the present invention are particularly suited for use on aircraft. For such use, the radome is also configured to be aerodynamically-shaped as shown by the radome 28 of FIGS. 2A-2C.

In particular, these figures show the radome to generally have a smooth blade configuration which gently transitions into the mounting plate 26. When the system is mounted on an aircraft, the ground plane of the mounting plate 26 may be effectively extended by the airplane's outer skin 27. Although the antenna system can be carried in different locations of an aircraft, FIG. 3 illustrates the system 20 carried on an upper fuselage portion of an aircraft 60.

It has been found that embodiments of the system 20 of FIGS. 1-3 can be configured and arranged to operate with high power (e.g., 100 watts) over extremely wide bands in the general frequency range from 200 MHz to 3 GHz. For example, FIGS. 4A-4C, 5A-5C and FIGS. 6A-6C and illustrate pitch, roll and yaw plane gain patterns which were respectively measured at 225 MHz, 1.2 GHz and 2.5 GHz on an embodiment of the system similar to that shown in FIG. 1.

Figure 4B:
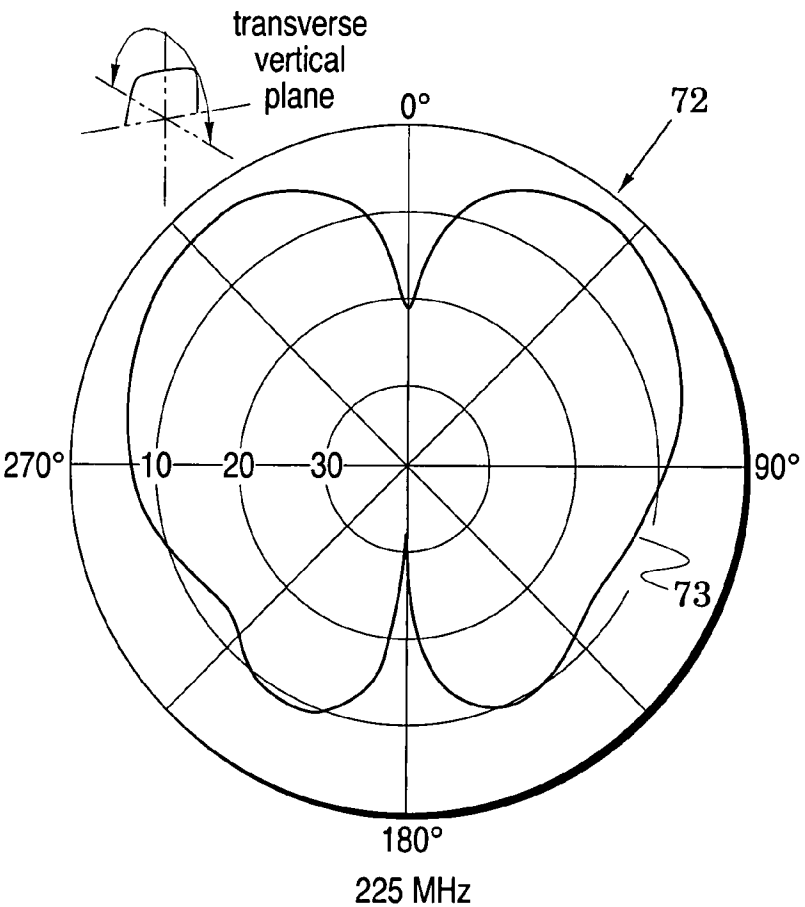
FIGS. 4A, 4B and 4C are respectively pitch, roll and yaw antenna patterns measured on an antenna embodiment at 225 MHz.
Figure 4A:
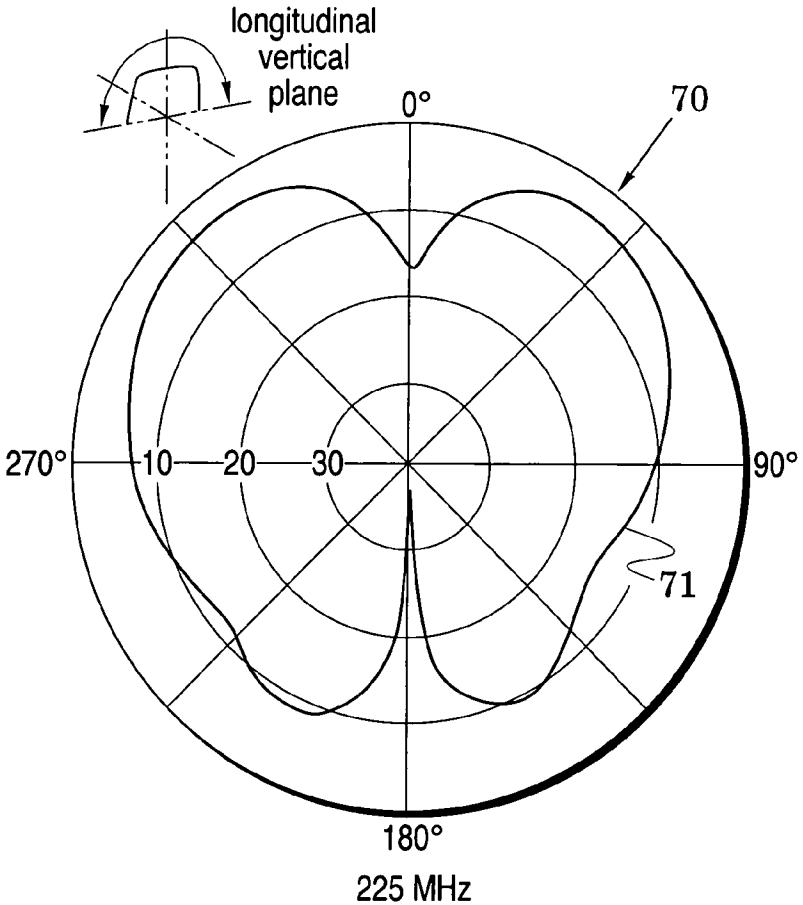

Initially directing attention to FIG. 4A, a graph 70 shows a gain pattern 71 that was obtained along the longitudinal vertical (pitch) plane of the antenna system of FIG. 1 at a frequency of 225 MHz. The orientation of the measured plane with the antenna is shown just above and to the left of the pattern. Graphs 72 and 74 of FIGS. 4B and 4C respectively show gain patterns 73 and 75 obtained along the system's transverse vertical (roll) plane and horizontal (yaw) plane at this same operational frequency.

Figure 5A:
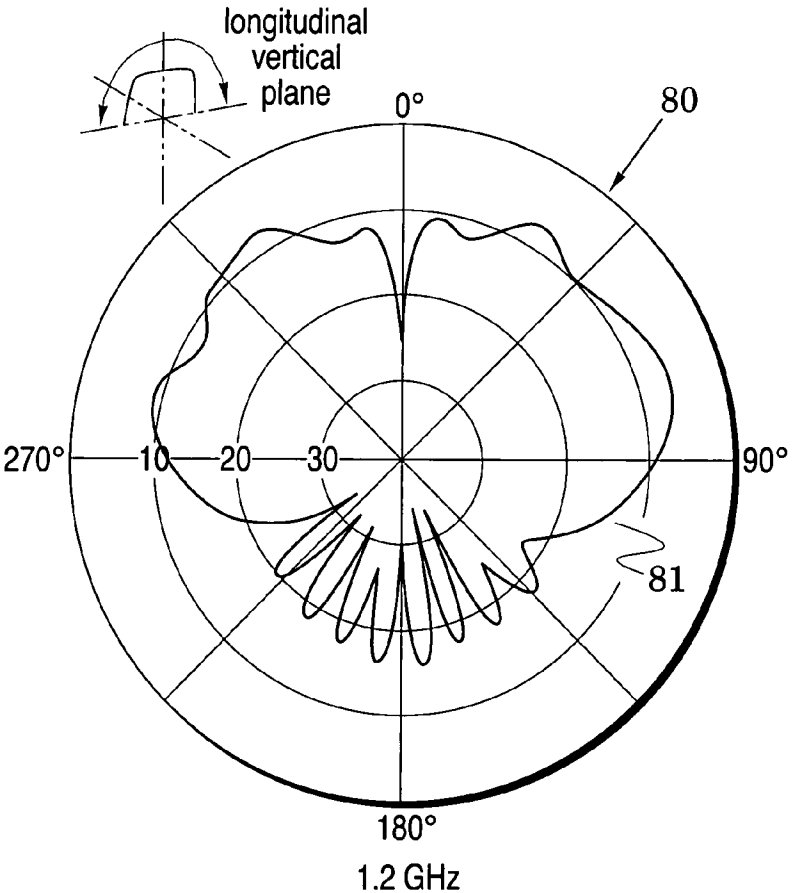
FIGS. 5A, 5B and 5C are similar to FIGS. 4A, 4B and 4C but measured at 1.2 GHz.
Figure 4C:
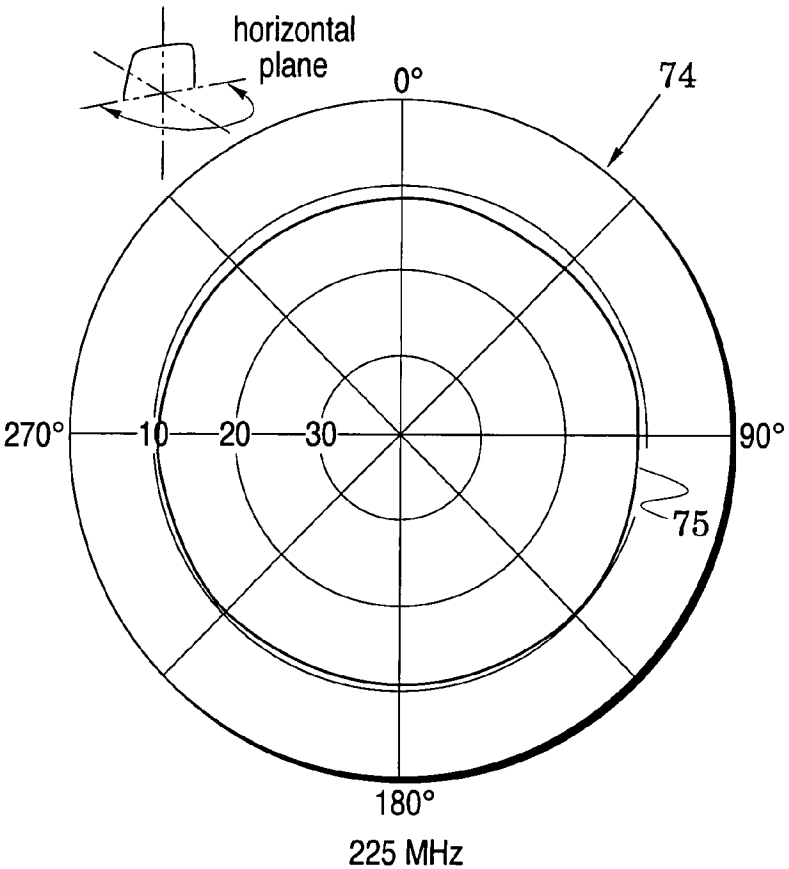
Figure 5C:
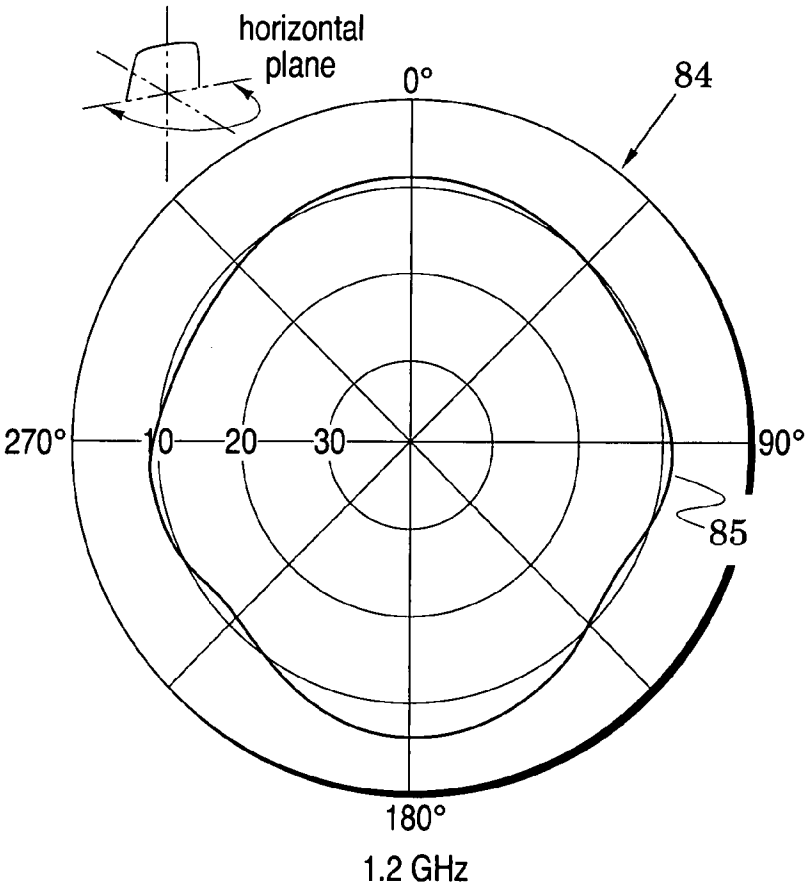
Figure 5B:
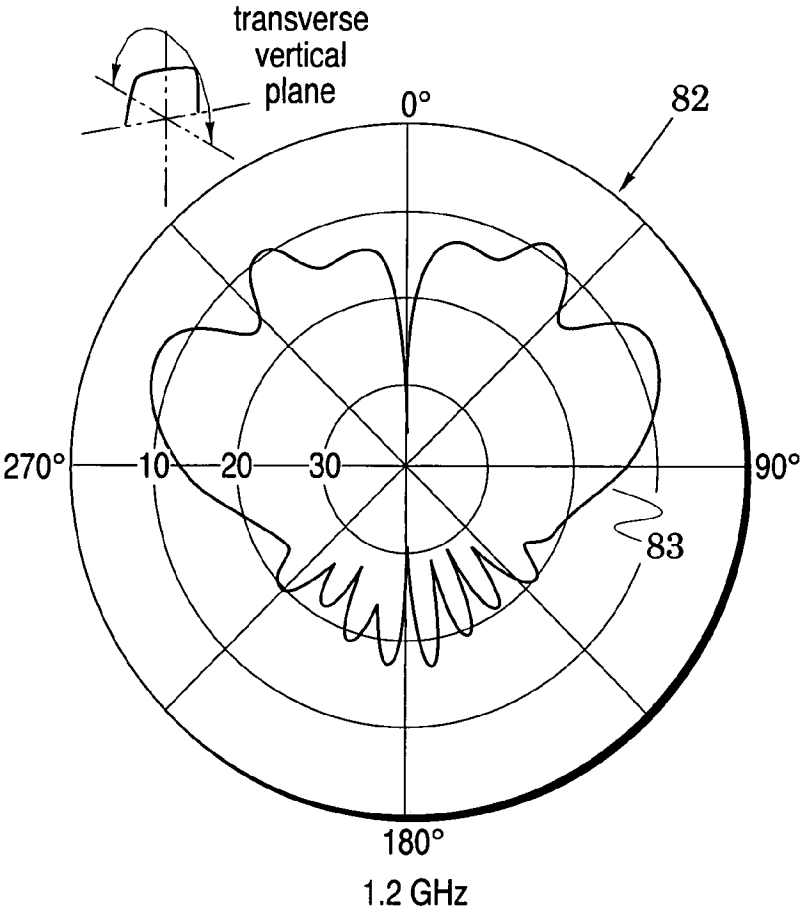

Graphs 80, 82 and 84 of FIGS. 5A-5C respectively show gain patterns 81, 83 and 85 that were obtained along the same system planes at an operational frequency of 1.2 GHz.

Figure 6B:
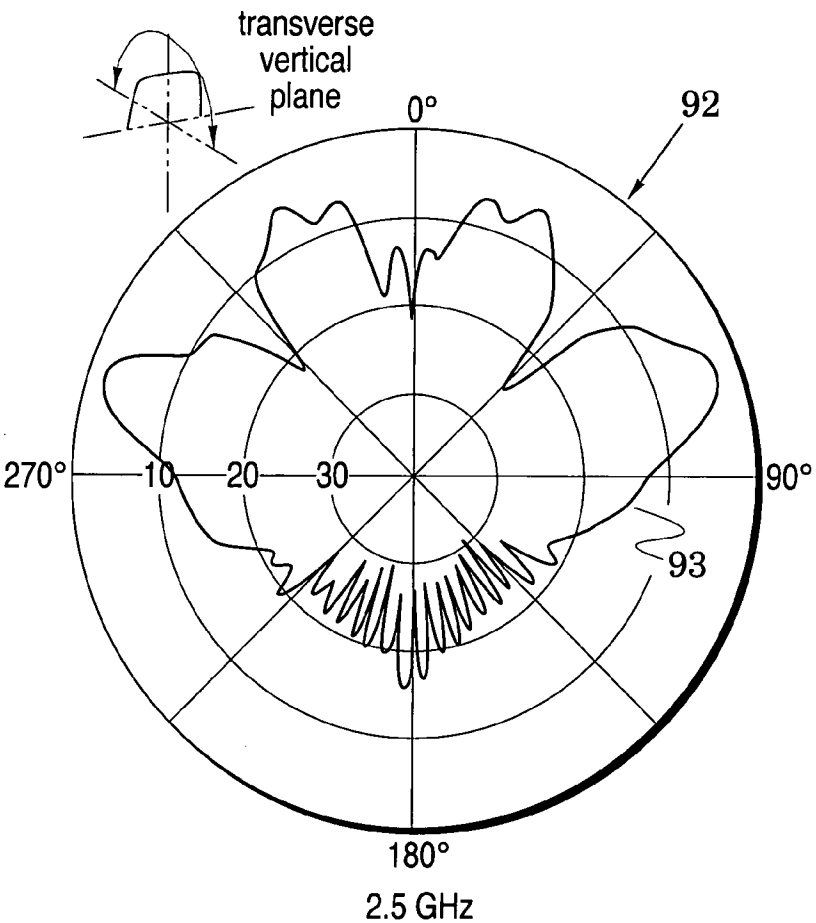
FIGS. 6A, 6B and 6C are similar to FIGS. 4A, 4B and 4C but measured at 2.5 GHz.
Figure 6A:
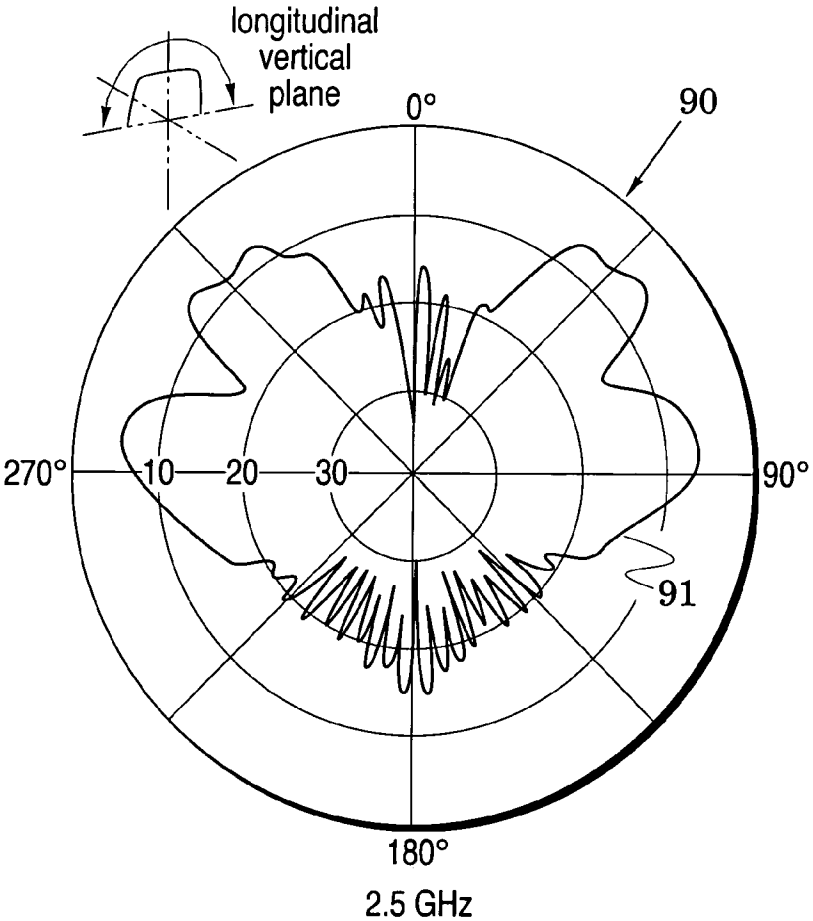
Figure 6C:
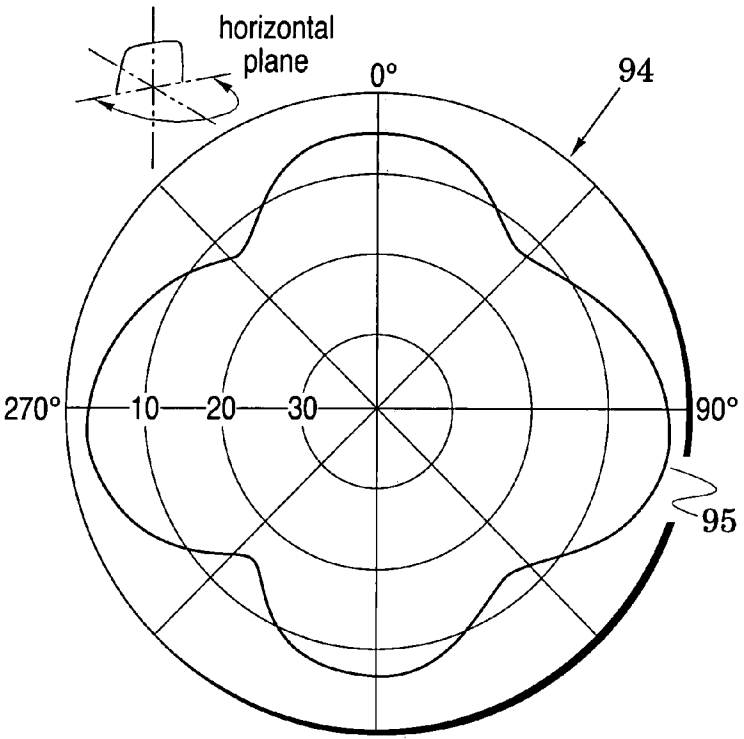

Finally, graphs 90, 92 and 94 of FIGS. 6A-6C respectively show gain patterns 91, 93 and 95 that were obtained along the same system planes at an operational frequency of 1.2 GHz.

The gain patterns at 225 MHz were measured on an outdoor test range with the antenna mounted at the center of a six foot diameter ground plane and the gain patterns at 1.2 and 2.5 GHz were measured in an anechoic chamber with the antenna mounted at the center of a four foot diameter ground plane.

The gain patterns of FIGS. 4A-6C show that the antenna structures of FIG. 1 are especially suited for realizing antenna gain that is substantially uniform across a wide frequency range. It is observed that the horizontal-plane gain remains essentially constant with some variations developing at the highest measured frequency. It is also observed that the gain along the vertical planes is relatively constant with additional lobes developing at the highest measured frequency.

Figure 7A:
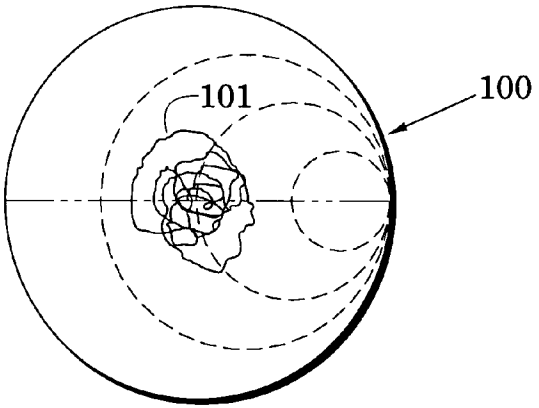
FIGS. 7A and 7B are respectively a polar VSWR plot and a return loss plot measured on a prototype antenna embodiment across a frequency range with markers at 225 MHz, 500 MHz, 1.22 GHz and 2.5 GHz.
Figure 7B:
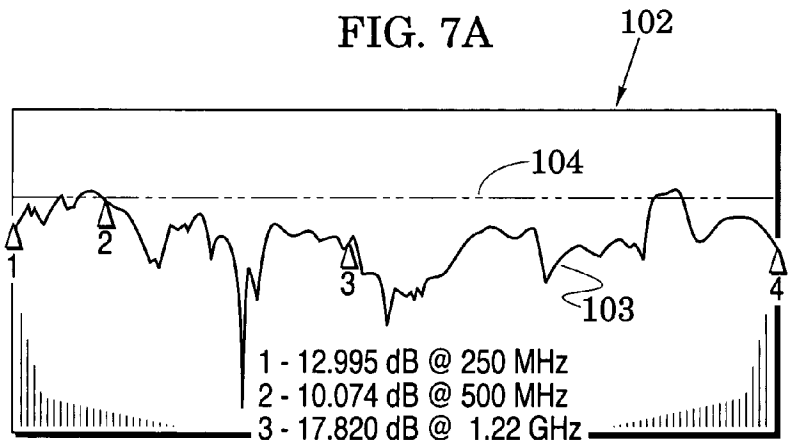

Graphs 100 and 102 of FIGS. 7A and 7B respectively show a VSWR pattern 101 and an RL pattern 103 that were measured with the antenna system 20 of FIG. 1. It is noted that VSWR is the ratio of maximum voltage to minimum voltage in standing wave patterns and varies from +1 to infinite. In contrast, RL is the dB value of absolute reflection coefficient. It is a concept of transmission engineering and its value varies from 0 for 100% reflection to infinite for an ideal connection. VSWR may be obtained from RL by the equation $$VSWR = \frac{10^{RL/20} + 1}{10^{RL/20} - 1} \tag{1}$$

and RL may be obtained from VSWR by the equation $$RL = 20\frac{VSWR - 1}{VSWR + 1}. \tag{2}$$

A perfect system in which all power is transmitted and none reflected would have a VSWR of 1.0 and an RL of infinity. An RL of −3 dB indicates that ½ of incident energy was transmitted and ½ was reflected. An RL that exceeds −10 dB is generally considered a figure of merit.

It is noted that the VSWR pattern 101 of FIG. 7A stays relatively close to the center (50 ohm point) of the graph 100 for frequencies between 250 MHz and 2.5 GHz. It is easier to observe the more detailed RL pattern 103 of FIG. 7B. For reference, an RL level of −10 is indicated by a broken line 104. With that reference, it is apparent that the measured RL significantly exceeds −10 dB in all but a couple of short frequency regions. Measured RL values are listed in FIG. 7B for frequencies of 250 MHz, 500 MHz, 1.22 GHz and 2.5 GHz whose locations are indicated by numbered triangles 1-4.

When an antenna embodiment is installed on an aircraft, it is important to provide a DC path between the antenna and the aircraft body to prevent charge buildups which can inject spurious signals into the received and radiated antenna signals. Accordingly, a DC discharge path in the form of a wire 106 is installed in FIG. 1 to couple together the mounting plate 26 and one of the outer blade members 300. The connection point on the blade member is particularly chosen to minimize any effect of the wire on the performance of the antenna 22. A lower outer corner of the blade member has been found to be an acceptable point. In other system embodiments, the wire 106 can be realized with a portion of the same metal layer that comprises the blade members 30.

The embodiments of the invention described herein are exemplary and numerous modifications, variations and rearrangements can be readily envisioned to achieve substantially equivalent results, all of which are intended to be embraced within the spirit and scope of the appended claims

We claim:

1. An antenna system, comprising:

a plurality of blade members positioned in a ring arrangement; and a connective path coupled to exchange electromagnetic energy with a base member of said blade members;

and further including:

a plurality of tuning circuits that are each coupled between a respective pair of said blade members;

a mounting plate;

a dielectric sheet that carries said blade members and is supported by said plate; and a monopole element supported by said dielectric sheet and coupled to exchange electromagnetic energy with said connective path.

2. The system of claim 1, wherein said blade members are defined by metal that is adhered to said dielectric sheet.

3. The system of claim 1, wherein said ring arrangment defines an aperture and said monopole element has an upper end positioned adjacent said aperture.

4. The system of claim 1, wherein each of said blade members is shaped to define a polygon.

5. The system of claim 4, wherein there are five blade members, said polygon is a pentagon and said ring arrangment defines a pentagonal aperture.

6. The system of claim 1, wherein each of said tuning circuits includes a reactive element.

7. The system of claim 6, wherein said reactive element is an inductor whose inductance generally increases with distance from said base member.

8. The An antenna system comprising:

a plurality of blade members positioned in a ring arrangement; and a connective path coupled to exchange electromagnetic energy with a base member of said blade members;

further including a plurality of tuning circuits that are each coupled between a respective pair of said blade members wherein each of said tuning circuits includes a reactive element;

and wherein:

each of said tuning circuits includes a path and a stub;

said ring arrangement defines a polygonal aperture;

said path is positioned adjacent said aperture; and said path and said stub are defined by said respective pair.

9. The system of claim 8, further including:

a connector that forms said connective path;

a mounting plate that carries said connector; and an aerodynamically-shaped radome that encloses said blade members and is joined to said mounting plate.

10. An antenna system, comprising:

a plurality of blade members positioned in a ring arrangement; and a plurality of reactive elements that are each coupled between a respective pair of said blade members;

wherein one of said blade members is a base member and said reactive elements are configured to provide reactances that generally increase with distance from said base member;

and further including:

a plurality of paths that are each coupled between a respective pair of said blade members; and a plurality of stubs that are each coupled between a respective pair of said blade members and each positioned between corresponding ones of said reactive elements and said paths; and wherein said paths and said stubs are defined by said blade members.

11. The system of claim 10, wherein each of said blade members is shaped to define a polygon and said ring arrangment defines a polygonal aperture.

12. The system of claim 10, further including:

a connector coupled to exchange electromagnetic energy with said base member;

a mounting plate that carries said connector;

a dielectric sheet that carries said blade members and is supported by said plate; and an aerodynamically-shaped radome that encloses said blade members and is joined to said mounting plate.

13. An antenna system, comprising:

a plurality of blade members positioned in a ring arrangement; and a plurality of reactive elements that are each coupled between a respective pair of said blade members;

wherein one of said blade members is a base member and said reactive elements are configured to provide reactances that generally increase with distance from said base member;

further including:

a connector coupled to exchange electromagnetic energy with said base member;

a mounting plate that carries said connector;

a dielectric sheet that carries said blade members and is supported by said plate; and an aerodynamically-shaped radome that encloses said blade members and is joined to said mounting plate;

and further including:

a conductor that is coupled to exchange electromagnetic energy with said connector; and an outer sleeve that surrounds said conductor wherein said ring arrangment defines an aperture and said conductor terminates at an end that is positioned within said aperture.

14. A method of configuring an antenna system, comprising the steps of:

positioning a plurality of blade members in a ring arrangement:

providing a connective path for exchange of electromagnetic energy with a base member of said blade members;

coupling each of a plurality of reactive elements between a respective pair of said blade members; and configuring said reactive elements to provide reactances that generally increase with distance from said base member;

and further including the steps of:

with each adjacent pair of said blade members, defining a path and a stub between that pair; and positioning each of said stubs between corresponding ones of said reactive elements and said paths.

15. The method of claim 14, further including the steps of:

configuring said blade members as polygons which define an aperture;

arranging a coaxial tube for exchange of electromagnetic energy with said connective path; and terminating said tube within said aperture.

* * * * *

UNITED STATES PATENT AND TRADEMARK OFFICE

CERTIFICATE OF CORRECTION

PATENT NO. : 7,633,451 B2
APPLICATION NO. : 11/488540
DATED : December 15, 2009
INVENTOR(S) : Seymour Robin and Rajah Castillo It is certified that error appears in the above-identified patent and that said Letters Patent is hereby corrected as shown below:

- Column 6, Claim 8, Line 36, should read as:

8. An antenna system comprising:

Signed and Sealed this

First Day of June, 2010

David J. Kappos

David J. Kappos
*Director of the United States Patent and Trademark Office*